US006802311B1

(12) United States Patent
Yeung

(10) Patent No.: US 6,802,311 B1
(45) Date of Patent: Oct. 12, 2004

(54) KITCHEN RANGE HOOD MOTOR HOUSING AND FAN

(76) Inventor: Peter Yeung, 4446 Frances Street, Burnaby, British Columbia (CA), V5C 2R4

( * ) Notice: Subject to any disclaimer, the term of this patent is extended or adjusted under 35 U.S.C. 154(b) by 0 days.

(21) Appl. No.: 10/445,224

(22) Filed: May 27, 2003

(51) Int. Cl.[7] ..... F24C 15/20
(52) U.S. Cl. ..... 126/299 R; 126/299 D
(58) Field of Search ..... 126/299 R, 299 D, 126/21 A; 55/DIG. 36, 406, 407; 454/49, 56, 67

(56) References Cited

U.S. PATENT DOCUMENTS

| | | | | |
|---|---|---|---|---|
| 4,133,300 A | | 1/1979 | Burton, Jr. et al. | |
| 4,500,331 A | | 2/1985 | Cheng | |
| 4,506,655 A | | 3/1985 | Kuechler | |
| 5,054,380 A | | 10/1991 | Hubbard | |
| 5,163,869 A | | 11/1992 | Yeh et al. | |
| 5,537,988 A | * | 7/1996 | Lin | 126/299 D |
| 6,216,686 B1 | * | 4/2001 | Chiu | 126/299 R |

FOREIGN PATENT DOCUMENTS

| | | | |
|---|---|---|---|
| DE | 4230420 | * | 4/1993 |

* cited by examiner

*Primary Examiner*—James C. Yeung
(74) *Attorney, Agent, or Firm*—Paul Smith Intellectual Property Law; Paul Smith

(57) ABSTRACT

A range hood motor housing and fan assembly for exhausting gases generated above a cooking surface. The motor housing has top, bottom and side surfaces defining a substantially cylindrical chamber within which a motor and fan are housed. An air outlet is present in the top surface. Space between the top surface and the fan increases in the direction of rotation of the fan from one side of the air outlet to the other side of the air outlet. The fan has a plurality of arcuate fan blades having at least one trough declining to the outer radial edge of the fan blade to direct any grease draining on the blade in this direction. The motor housing may be equipped with an air exhaust chamber projecting from the motor housing and connected to the range hood body for recycling air from above the cooking surface back into the cooking environment.

22 Claims, 16 Drawing Sheets

KITCHEN RANGE HOOD MOTOR HOUSING AND FAN

FIELD OF THE INVENTION

This invention relates to range hoods for use in domestic kitchens, and more particularly to a motor housing and single fan assembly for use in a range hood for drawing grease laden air from above a cooking surface and venting to an external location.

BACKGROUND OF THE INVENTION

Range hoods are used above cooking surfaces to remove grease, common odors and hazardous gases created during the cooking process. The range hood has an outer hood body having top, bottom and side panels defining an enclosure. A motor housing having top, bottom and side surfaces defining a further enclosure is contained within the outer body.

There are two basic designs for range hoods for domestic use—a single motor design and a double motor design. An example of the single motor design is shown in U.S. Pat. No. 4,500,331. The '331 patent teaches a motor housing having top and bottom surfaces, a curved outer wall and an extended end portion. There is an air inlet in the bottom surface and an air outlet in the top surface in the area of the extended end portion. An electric motor is mounted to the top of the housing and a centrifugal fan attached to it. The motor and fan are positioned above the air inlet. The space between the outer circumference of the fan and the curved outer wall of the housing increases in the direction of rotation of the fan, the space being the largest in the area of the extended end portion, thereby maximizing air flow. In order to maximize the size of the motor and fan employed, the extended end portion and the outlet vent located there are positioned off center within the range hood body (the range hood being larger from side to side than from front to back).

For individuals making greater use of grease when cooking, a more powerful range hood, such as the double motor design, is needed for proper removal of the grease fumes generated. In the double motor design, the motor housing has top, bottom and perimeter side surfaces defining an enclosure having two substantially mirror chambers, each with an air inlet at the bottom and an air outlet at the top. A motor and fan is positioned in each chamber above the air inlet. The fans suck air from the cooking area below and force it through the motor housing chambers to the air outlet where it is directed by ventilation piping to the outside. The space between the outer circumference of the fan and the perimeter side surface of the respective chamber of the housing increases in the direction of rotation of the fan, the space being the largest in the area of the air outlet. By having two motors and fans, greater suction power is provided. In addition, the air outlet may be centered between the sides of the range hood.

While more powerful, the double motor design range hood is more costly to produce. In addition to requiring two motors and fans and the additional wiring and electronics associated with this, the motor housing itself is larger requiring greater material for production.

Accordingly, it is an object of an embodiment of the invention to provide a range hood having a single motor and fan that is more powerful than the single motor and fan design of similar sized range hoods of the prior art.

Not all aspects of the invention necessarily address such object. Other objects of the invention will be apparent from the description that follows.

SUMMARY OF THE INVENTION

According to the preferred embodiment of the present invention there is provided a range hood motor housing and fan assembly. The assembly comprises a motor housing having top, bottom and side surfaces defining a chamber that is mounted within a range hood body. A motor is housed within the motor housing chamber, the motor including a fan having a plurality of fan blades. The fan is adapted to rotate about the motor. An air outlet is located in the motor housing. Space between the fan blades and the top surface of the motor housing increases in the direction of rotation of the fan from one side of the air outlet to the opposite side of the air outlet.

In another aspect, the motor housing further comprises an upper section and a lower section, the sections being releasably connectable to one another.

In yet a further aspect, the lower surface of the motor housing has a wall projecting into the chamber defining an air inlet. The air outlet is located in the top surface of the motor housing.

In yet a further aspect, the fan comprises a plurality of arcuate fan blades having front and rear faces, a basket housing, and an outer cylindrical stabilizing element. The fan blades project radially from the basket housing to the outer cylindrical stabilizing element. The fan blades may have at least one trough on their respective front faces. The troughs decline at an angle from the basket to the stabilizing element.

In yet a further aspect the side surface is substantially cylindrical and is substantially concentric to the stabilizing element.

In an alternative embodiment of the assembly described above, a portion of the top surface and of the air outlet overlaps the bottom surface.

According to the present invention there is provided a fan for use within a range hood for exhausting gases generated above a cooking surface comprising a plurality of arcuate fan blades having front and rear faces, a basket housing and an outer cylindrical stabilizing element. The fan blades project radially from the basket housing to the outer cylindrical stabilizing element.

According to an alternative embodiment of the present invention, there is provided a motor housing and fan assembly as detailed above that further comprises an air exhaust chamber. The air exhaust chamber has an inlet portion, an intermediate portion and an outlet portion. The inlet portion connects to the motor housing. The outlet portion connects to an opening in the hood body. Air from the motor housing passes through an opening into the inlet portion, through the intermediate portion and then is vented through venting slits in the outlet portion through the opening in the hood body to the range hood exterior.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

Figure 1:
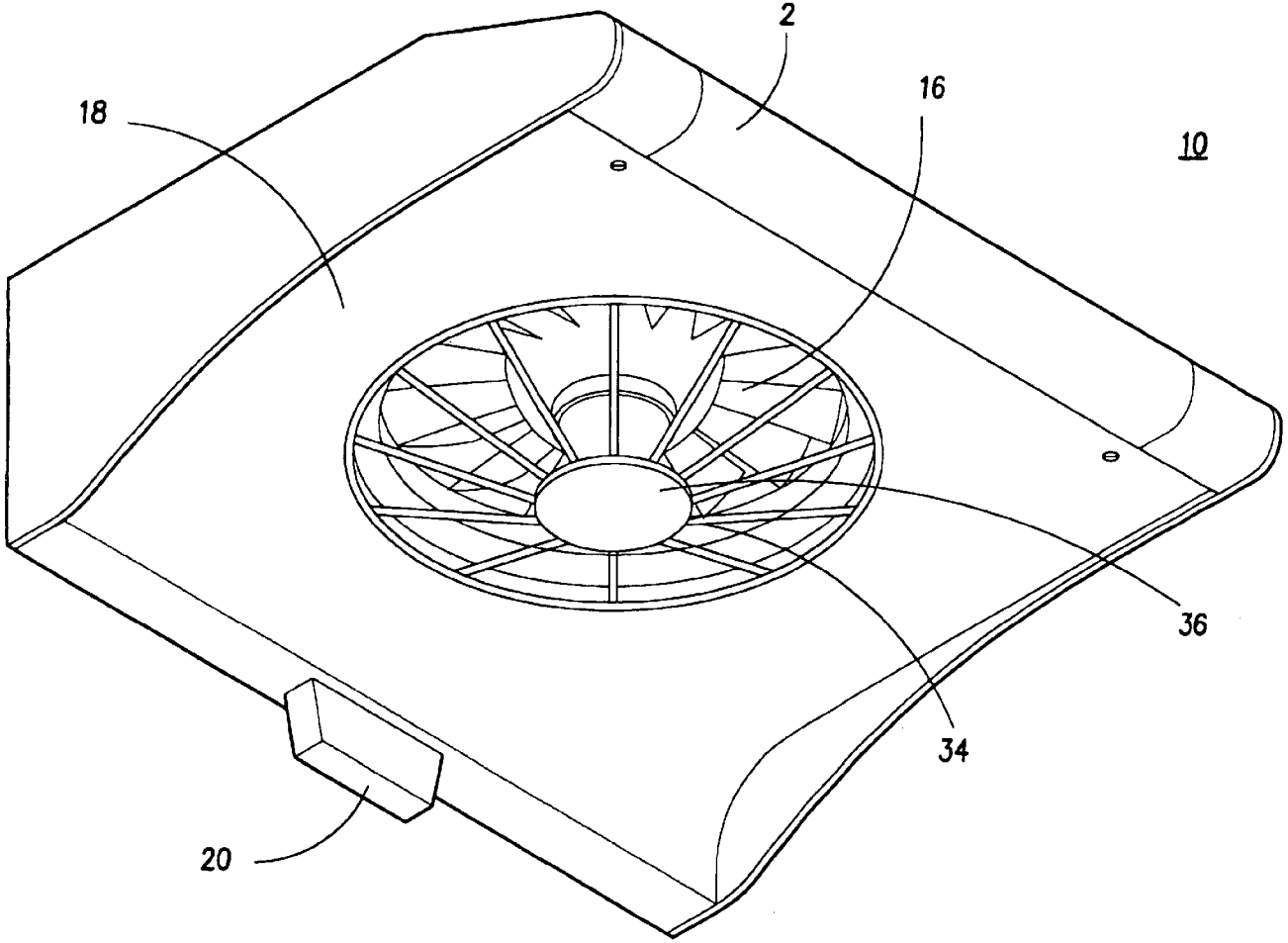
FIG. 1 is a perspective view from the bottom of a range hood having the preferred embodiment of the motor housing and fan assembly according to the invention.
Figure 2:
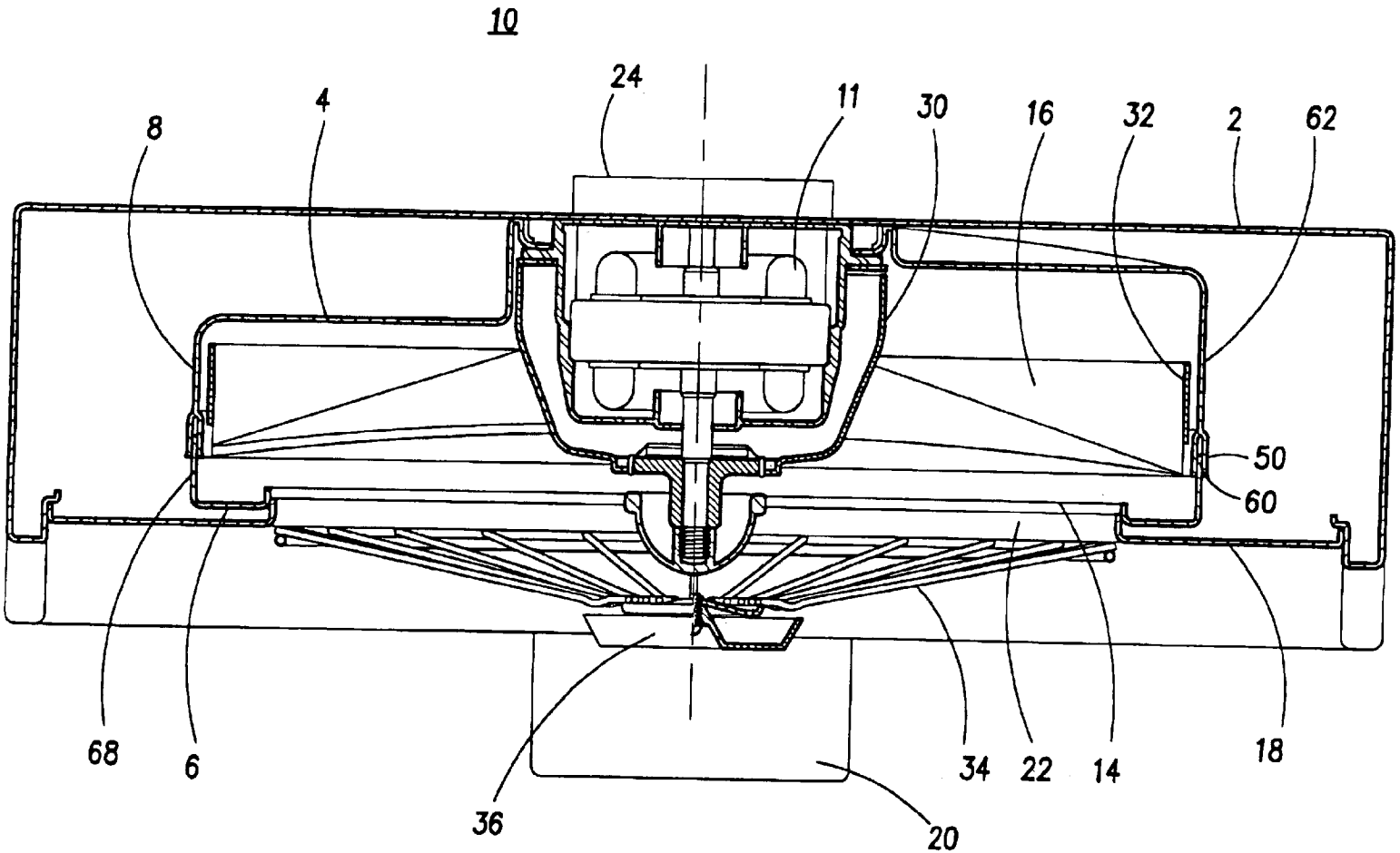
FIG. 2 is a cross sectional view looking towards the rear of the range hood of FIG. 1.
Figure 3:
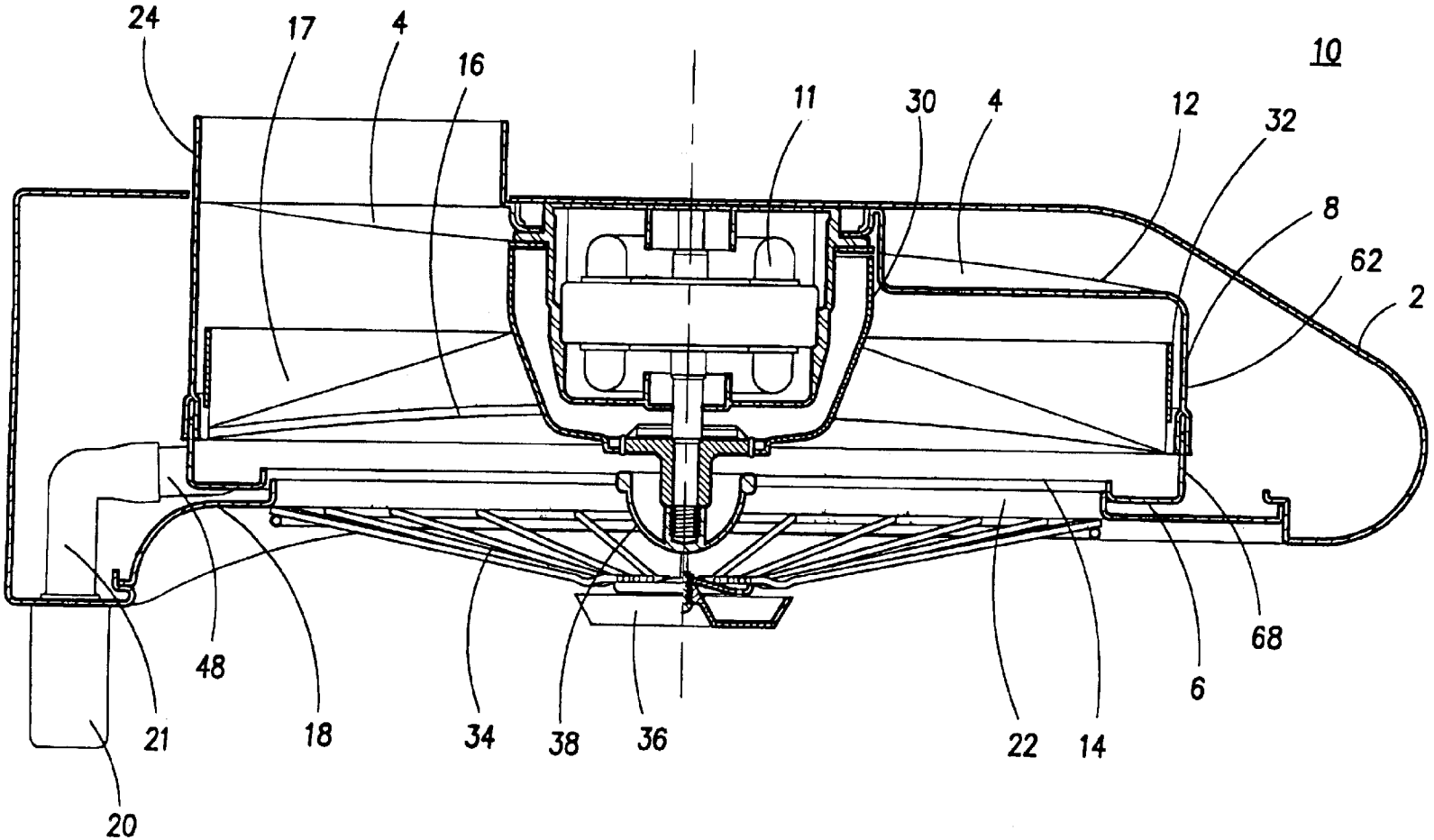
FIG. 3 is a side cross sectional view of the range hood of FIG. 1.

The present invention relates to a kitchen range hood and in particular a motor housing and fan assembly for use in a range hood. The preferred embodiment of a range hood with a motor housing and fan assembly according to the invention is illustrated in FIGS. 1–3.

Range hood 10 has an outer hood body 2 having top, bottom and side surfaces defining an enclosure. A lower panel 18 having a wall 22 defining an air inlet may be removably connected to the outer body 2. A motor housing 12 is mounted within the range hood enclosure. The motor housing has a top surface 4, a bottom surface 6 and a curved side surface 8 defining a further enclosure. There are two openings in the top surface 4 of the motor housing: an air outlet defined by ventilation wall 24 and a housing mount 26. Bottom surface 6 has a wall 14 projecting upwardly into the motor housing enclosure that defines a motor housing air inlet. Preferably both the lower panel and the motor housing air inlets are circular and are positioned such that wall 22 and wall 14 are in abutment when lower panel 18 is mounted in hood body 2.

The housing mount 26 is dimensioned to accommodate a motor 11, mounted within the motor housing enclosure. When motor housing 12 is mounted in place, ventilation wall 24 projects through an opening in the top surface of the hood body and is substantially centered between the sides as shown in FIG. 2. Both the motor 11 and the housing mount 26 are adapted to be removably attached to the hood body 2. A fan 16 is connected to motor 11 by way of fan cap 38. The fan 16 has an inner basket housing 30 that surrounds the motor 11. Fan blades 17 project radially from the basket housing connecting to a cylindrical stabilizing element 32 that prevents the fan blades from distorting during operation. When the motor 11 is activated, fan 16 is rotated thereby acting to draw air through the lower panel and motor housing air inlets and into the motor housing where it is then forced out the air outlet to be vented to an exterior location, for example by way of a conduit (not shown) attached to ventilation wall 24 and leading to the exterior location.

During operation of the range hood, some of the vapourized grease and the like in the air drawn into the motor housing condenses on its interior surfaces. In addition to defining the air inlet, wall 14 also acts to prevent this accumulated grease and liquid from draining back through the air inlets to the cooking surface below. The bottom surface 6 of the motor housing is angled from front to back so that any accumulated liquid is directed by gravity towards drain 48. Drain 48 is therefore located at the lowest point of bottom surface 6 of the motor housing. As seen in FIG. 3, a pipe 21 is attached to drain 48 in order to direct any liquids to external grease cup 20.

Figure 4:
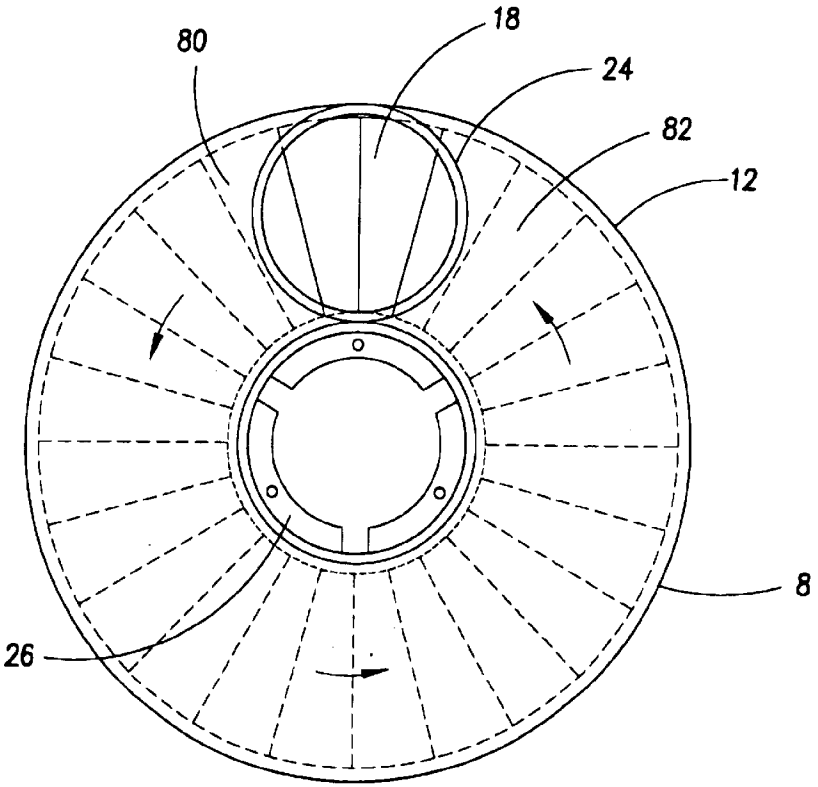
FIG. 4 is a top plan view of the motor housing shown in FIGS. 2 and 3.

In the preferred embodiment, the motor housing 12 is substantially cylindrical, with a minimal amount of space between the cylindrical stabilizing element 32 and the curved side surface 8. The fan is designed to force air towards the top surface 4 of the motor housing and in the direction of rotation of the fan, indicated by arrows in FIGS. 4 and 5. The space between the top surface 4 of the motor housing and the top of the fan blade 74 increases in the direction of rotation of the fan starting at a first position and ending at a second position, with the air outlet defined between the two. The space between the top of the fan blade 74 and the top surface 4 is smallest in the area 80 adjacent the ventilation wall on the downwind side and greatest in the area 82 adjacent the ventilation wall on the upwind side. Preferably the sloping top surface 4 is substantially perpendicular to the side surface 8 along any radial axis of the motor housing as shown in FIG. 3. The housing mount 26 and motor are also cylindrical and are concentric to side surface 8. Looking at FIG. 5, the top surface can be seen to slope around the housing mount 26. Increasing the space between the fan 16 and the top surface 4 of the motor housing in this fashion maximizes the air flow.

By minimizing the space between the cylindrical stabilizing element 32 and the curved side surface 8, the size of the fan may be maximized. The size of the air inlets and the motor may also be increased. The motor housing and fan assembly therefore results in a more powerful range hood as compared to the single engine range hoods of the prior art. In addition, costs may be reduced as compared to the double engine range hoods, as only one motor and fan are required.

Figure 6:
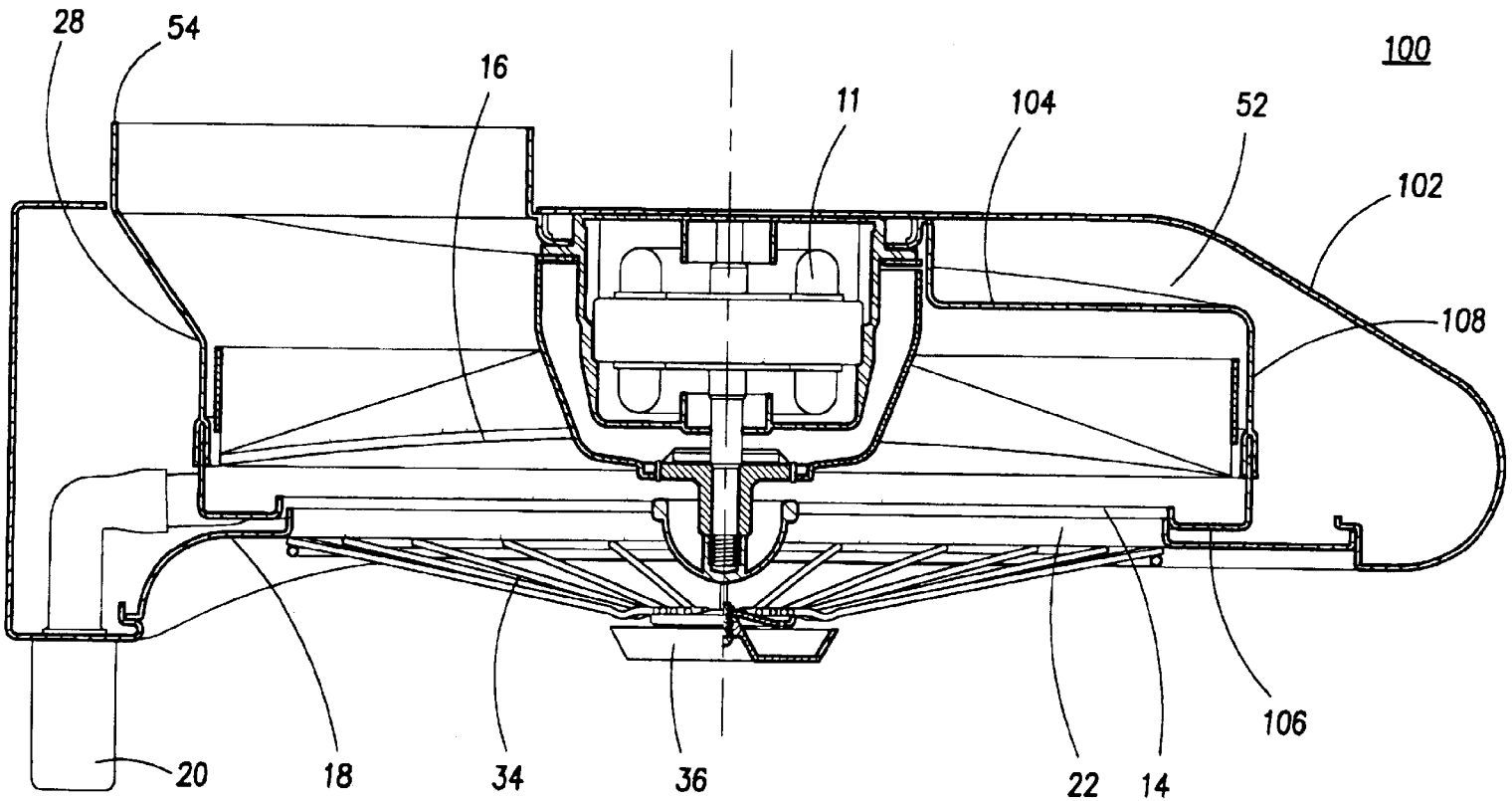
FIG. 6 is a cross sectional view of a range hood having an alternative embodiment of the motor housing and fan assembly.
Figure 7:
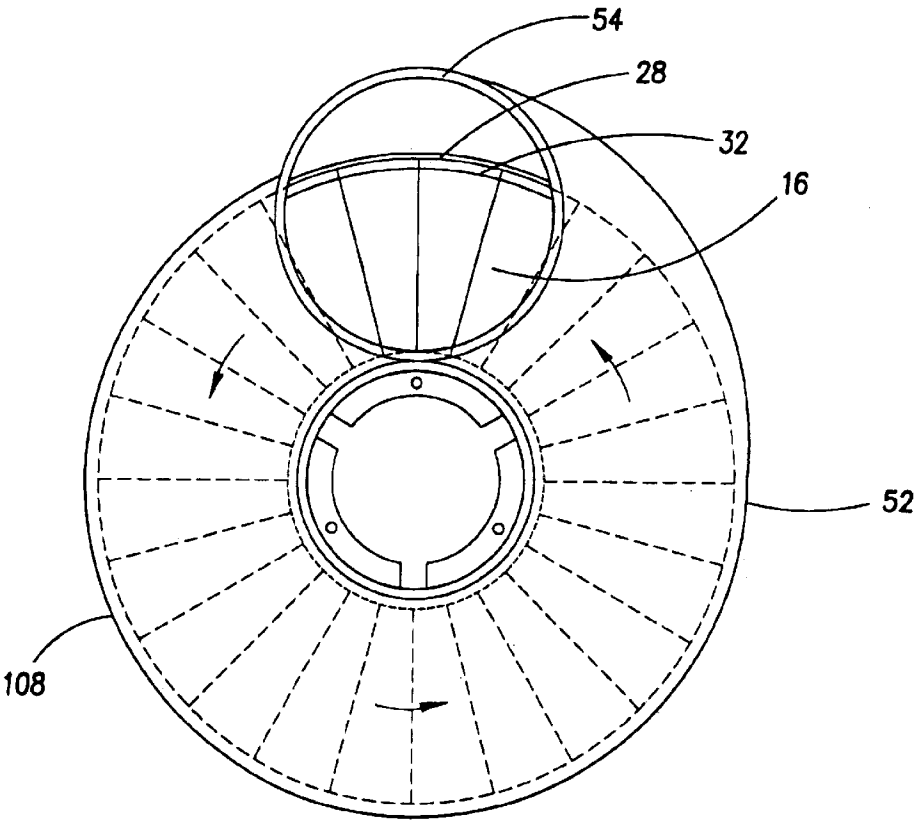
FIG. 7 is a top plan view of the motor housing shown in FIG. 6.
Figure 8:
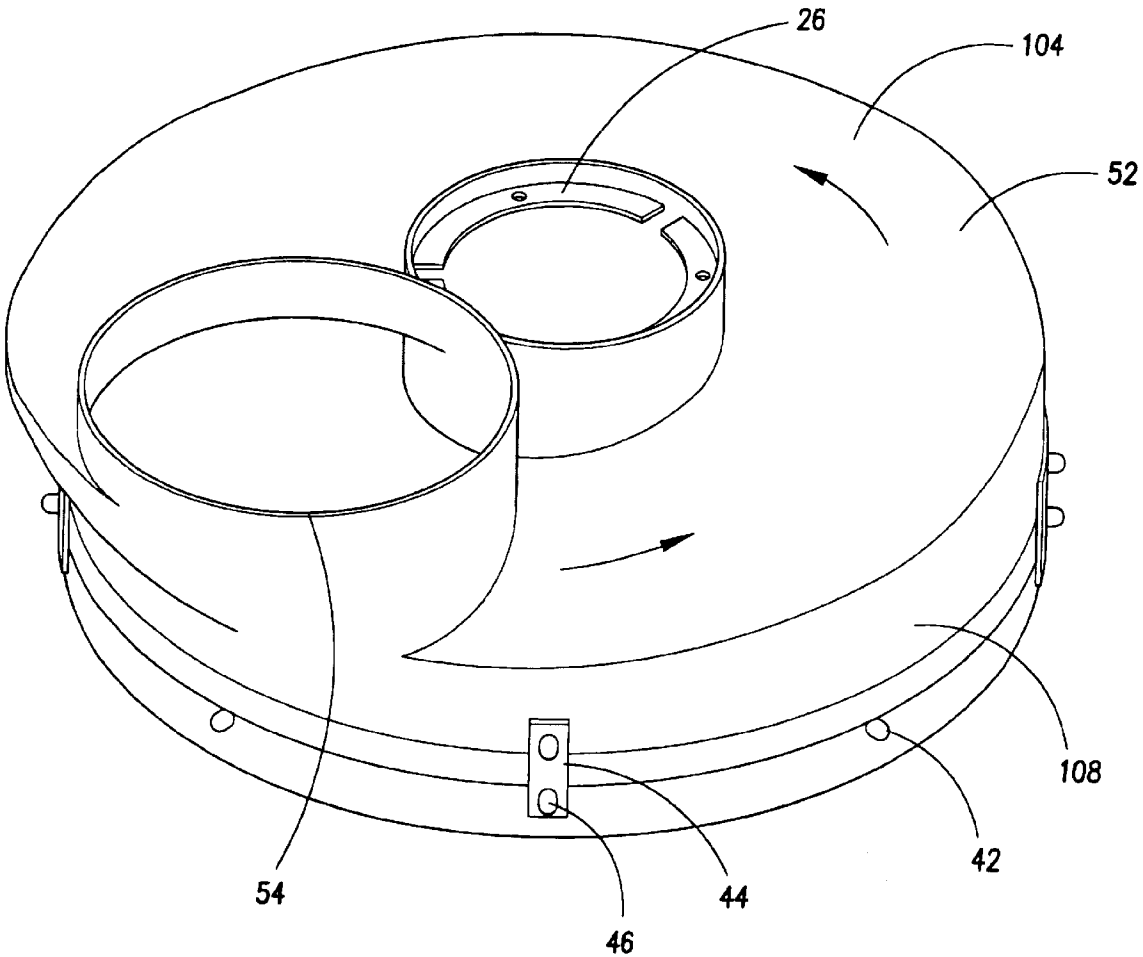
FIG. 8 is a perspective view of the motor housing shown in FIG. 6.
Figure 9:
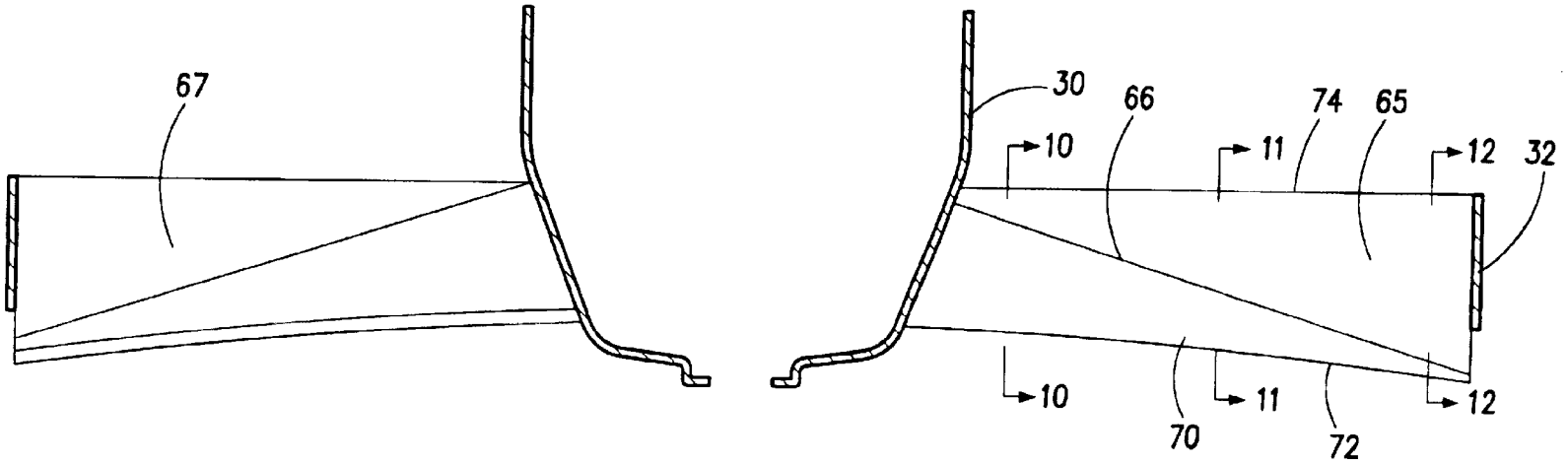
FIG. 9 is a cross section of the fan shown in FIG. 3.

In an alternative embodiment shown in FIGS. 6–8, additional space is created for improved air flow. Identical reference numbers have been used to indicate those aspects of the alternative embodiment that are the same as the preferred embodiment described above. Range hood 100 has a hood body 102 with vent 54 projecting through it. The motor housing 52 is similar to that of the preferred embodiment, but has a larger air outlet defined by vent wall 54 that overlaps the bottom surface 106 of the motor housing. On the upwind side of the air outlet, upper surface 104 of the motor housing also overlaps the bottom surface 106, the overlap decreasing in the reverse direction of fan rotation. The curved side wall 108 has an angled portion commencing at a point (marked as reference number 28) just above the top of the fan blades 74 up to upper surface 104 and to the vent wall. The angling of this portion of the side wall increases to a maximum in the area of the air outlet. The additional space created by this angling allows a greater volume of air to be pushed through the motor housing during operation. However, this alternative embodiment is more costly to manufacture.

Preferably, the motor housing has an upper section 62 and a lower section 68 that are removably connectable at joint 50. Should a user need to remove the fan 16, or wish to clean the inside of the motor housing, lower section 68 may simply be removed. The joint 50 may be comprised of a Y-shaped cooperating projection 40 on one side of the joint, into which the edge 60 of the side of the lower section is inserted. Cooperating projection 40 is angled inward at the tips of the Y to provide guidance and ensure proper insertion of edge 60. The cooperating projection 40 and edge 60 are sized to provide a snug friction fit between the pieces when connected.

Figure 5:
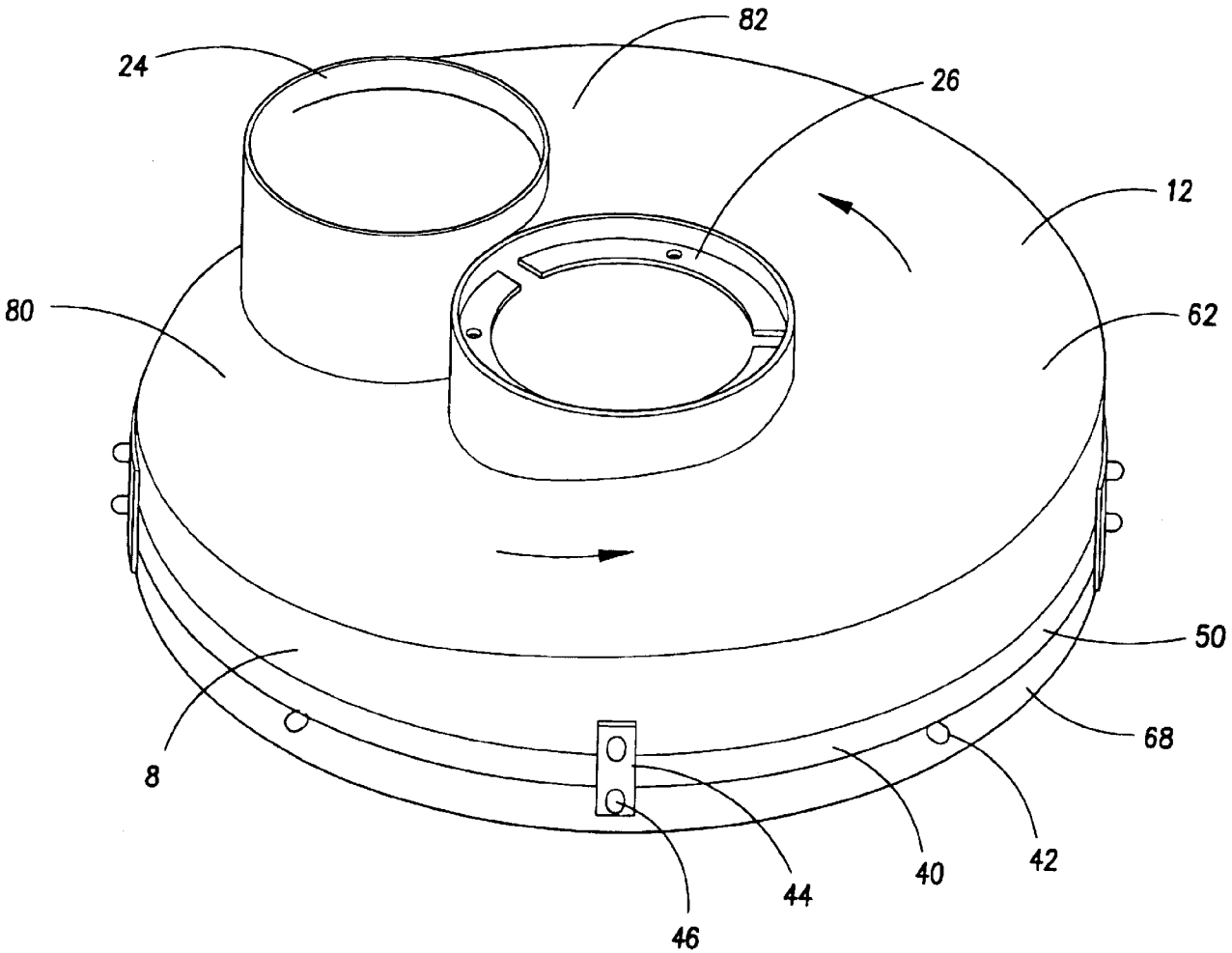
FIG. 5 is a perspective view of the motor housing shown in FIGS. 2 and 3.

Alignment pins or protrusions 42 are placed at intervals around the perimeter of the motor housing 12, as shown in FIG. 5. The alignment pins 42 are positioned on the outside surface of the edge 60 to provide guidance as to how far the two housing sections 62, 68 have to be pushed together to ensure a tight fit. The sections are pushed together until cooperating projection 40 abuts alignment pins 42. The alignment pins 42 also provide a visual guide, allowing visual inspection of the housing to ensure it is properly reassembled.

Preferably, some form of additional restraints are spaced at intervals around the perimeter of the housing 12 to ensure that the upper and lower sections 62, 68 of the housing 12 stay in place once connected. As shown in FIG. 5 the restraint may comprise a pair of reinforcing pins 46 and a reinforcing strap 44. The pairs of reinforcing pins are spaced about the periphery of the curved surface 8, with one pin integral with the upper section 62 and the other pin integral with the lower section 68. The reinforcing strap 48 is dimensioned so that when the upper and lower sections are connected, the reinforcing strap 48 may slide over the pins 46. The reinforcing strap 48 may then be locked into place by insertion of cotter pins (not shown), or a similar locking mechanism such as a cable tie or twist tie, into grooves in reinforcing pins 46. Alternatively, reinforcing pins 46 could take the form of self-locking pins or bolts, in which case reinforcing strap 48 would be replaced by nuts. It is contemplated that other restraints would also work.

Preferably, the motor housing 12 is made of plastic, with pins 42 and 46 molded and integral to the housing. However, the motor housing may also be constructed of metal and if so, the pins 42 and 46 will preferably be welded onto the side of the upper and lower housing sections 62, 68. Such fabrication will provide the strongest fastening means to reinforce the connection between upper section 62 and lower section 68.

Figure 12:
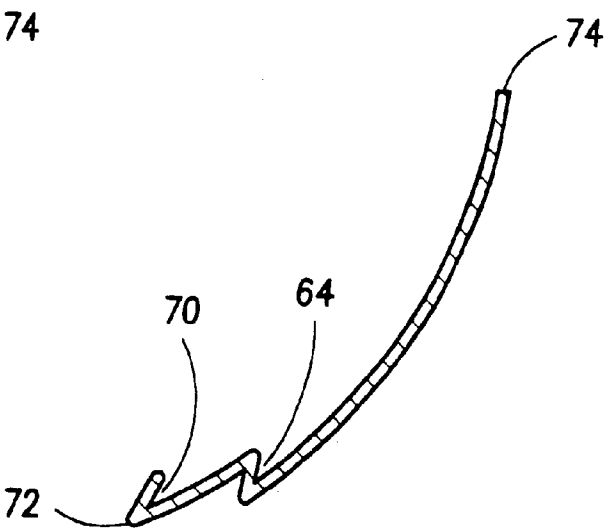
FIG. 12 is a sectional view of the fan blade shown in FIG. 9 taken along line 12-12.
Figure 11:
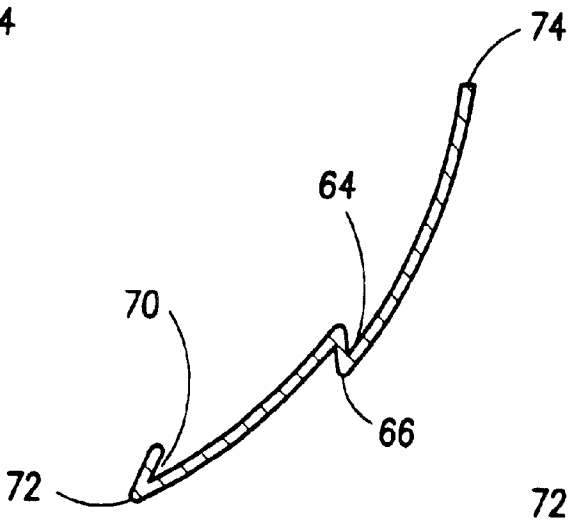
FIG. 11 is a sectional view of the fan blade shown in FIG. 9 taken along line 11-11.
Figure 10:
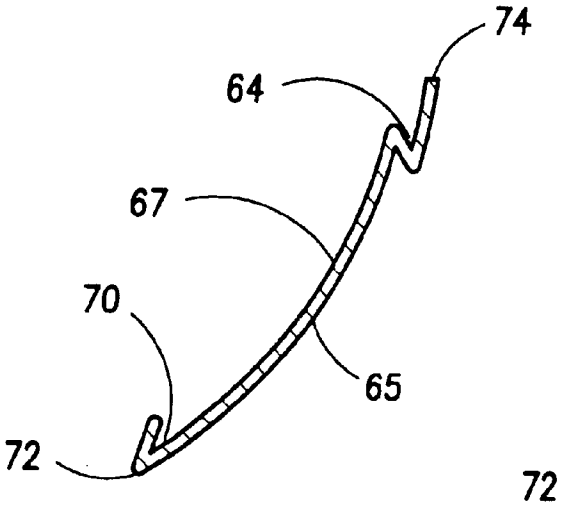
FIG. 10 is a sectional view of the fan blade shown in FIG. 9 taken along line 10-10.

Typically only a very small amount of grease accumulates on a fan as most is dispersed by means of the centripetal force of the rotating fan. However, because the air is being forced against the top surface of the motor housing, some grease may drip down. Grease will also accumulate on the interior of the vent wall and will drip down after the range hood has been turned off. In order to prevent any grease from dripping back down through the air inlets, the fan blades act as grease catchers. This is best illustrated in FIGS. 10–12. Preferably the blades 17 of the fan 16 are arcuate and positioned so that the top surface 74 of one fan blade overlaps the lower surface 72 of the adjacent fan blade. Grease dripping from the air outlet or the top surface of the motor housing will land on the front face 67 of the fan blade 17. Two troughs 64, 70 on the front face 67 angle downward from the inner basket housing 30 towards the cylindrical stabilizing element 32. Grease on the fan blade will be directed by the troughs to outer perimeter of the motor housing where it may drip onto the bottom surface of the motor housing, eventually draining out to external grease cup 20. Minimal grease will accumulate on the back face 65 of the fan blade 17. That grease that does attach to the fan during operation will be forced radially outward by the centripetal force from the rotating fan. Cylindrical stabilizing element 32 is a circular band, preferably metal, providing structural rigidity to the blades. Any grease collecting on element 32 will drain to the floor of lower surface 6.

While both the preferred and alternative embodiments have been shown with a protective fan grill 34 and a fan drain cap 36 connected to the lower panel 18, it is also contemplated that a filter could be used. The filter would provide further protection from grease dripping back down to the cooking surface below the range hood however would limit the amount of air drawn into the housing as compared to a range hood without the filter.

A further alternative embodiment is shown in FIGS. 13–16. Not all homes are equipped with the appropriate ducting to accommodate the range hood of the preferred embodiment. Accordingly, in addition to the elements described in relation to the preferred embodiment including air outlet 240, range hood 200 is also equipped with a further air exhaust chamber 220. Air chamber 220 allows for the recycling of air drawn into the range hood back into the room.

Air exhaust chamber 220 extends from opening 272 in wall 274 in the top section 204 of the motor housing. Air chamber 220 has an inlet portion 250, and intermediate portion 260 and an outlet portion 224 having openings in the form of venting slits formed therein. Preferably, inlet portion 250 extends out past the outer radial edge 208 of the motor housing and intermediate and outlet portions 260, 224 are adjacent the perimeter 208 of the motor housing as shown best in FIG. 14. Outlet portion 224 is mounted under the top surface of hood body 202 in alignment with an opening 203 in the hood body such that gases may be recycled out of the range hood to the range hood exterior.

Because range hood 200 may be operated in two different ways, it may be equipped with a filter 206 and a fan grill 34. The user may then select how they would like to use the range hood. Should they wish to attach it to appropriate ducting for external ventilation of gases, ducting is attached to outlet 240. Filter 206 may or may not be used depending on the user's preference. If no filter is present, fan grill 34 and grease cap 36 provide a level of safety for the user. Cover 270 is placed over opening 272 in order to prevent air from entering air chamber 220 so that all air drawn into the motor housing is forced out the air outlet 240 and the attached ducting. It is also contemplated that cover 270 could form an integral part of wall 274 but having a weakened break-away seam so that if desired it may be removed as discussed below.

Figure 13:
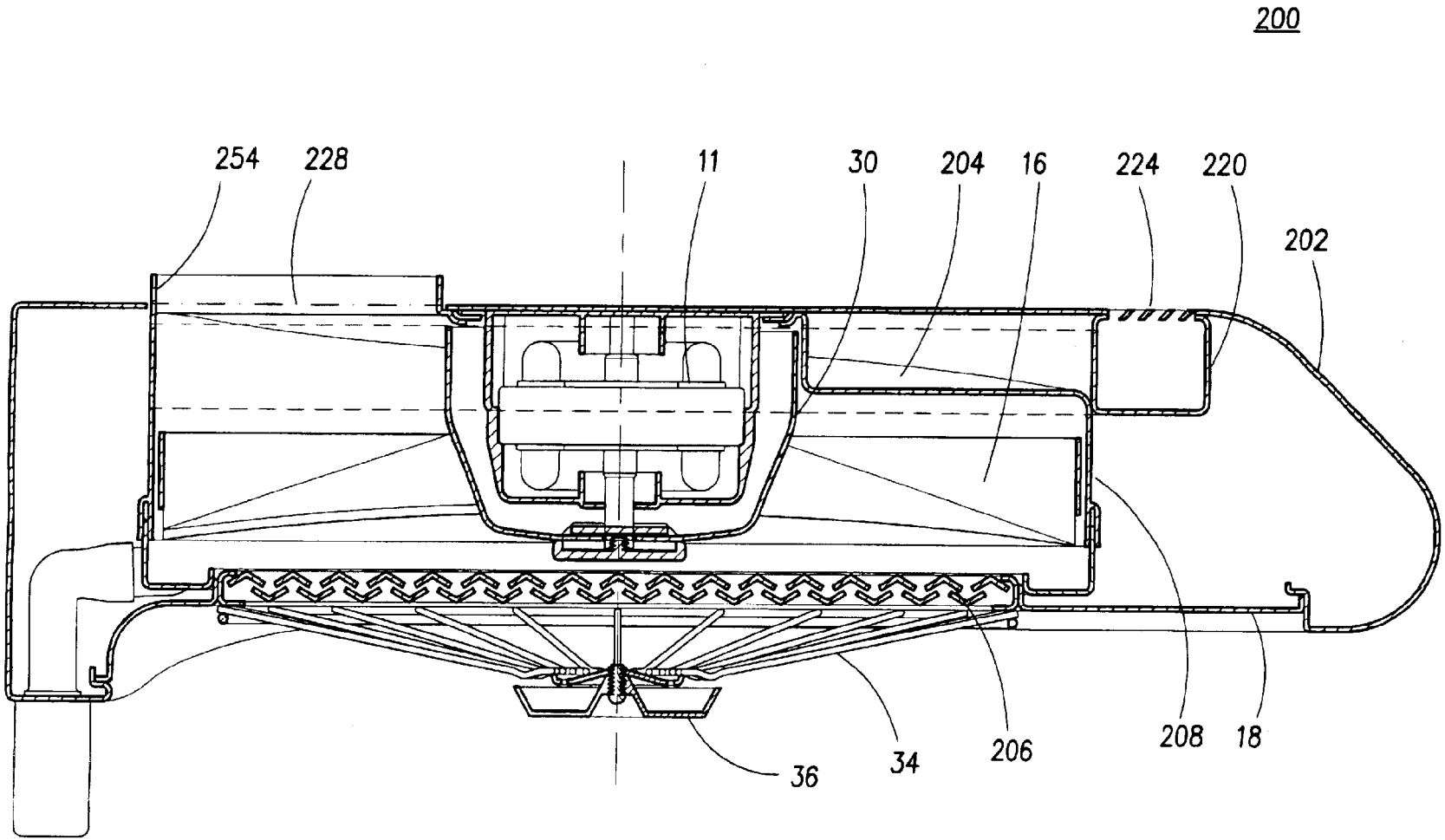
FIG. 13 is a is a cross sectional view of a range hood having a motor housing and fan assembly having an exhaust chamber according to an alternative embodiment of the invention.
Figure 14:
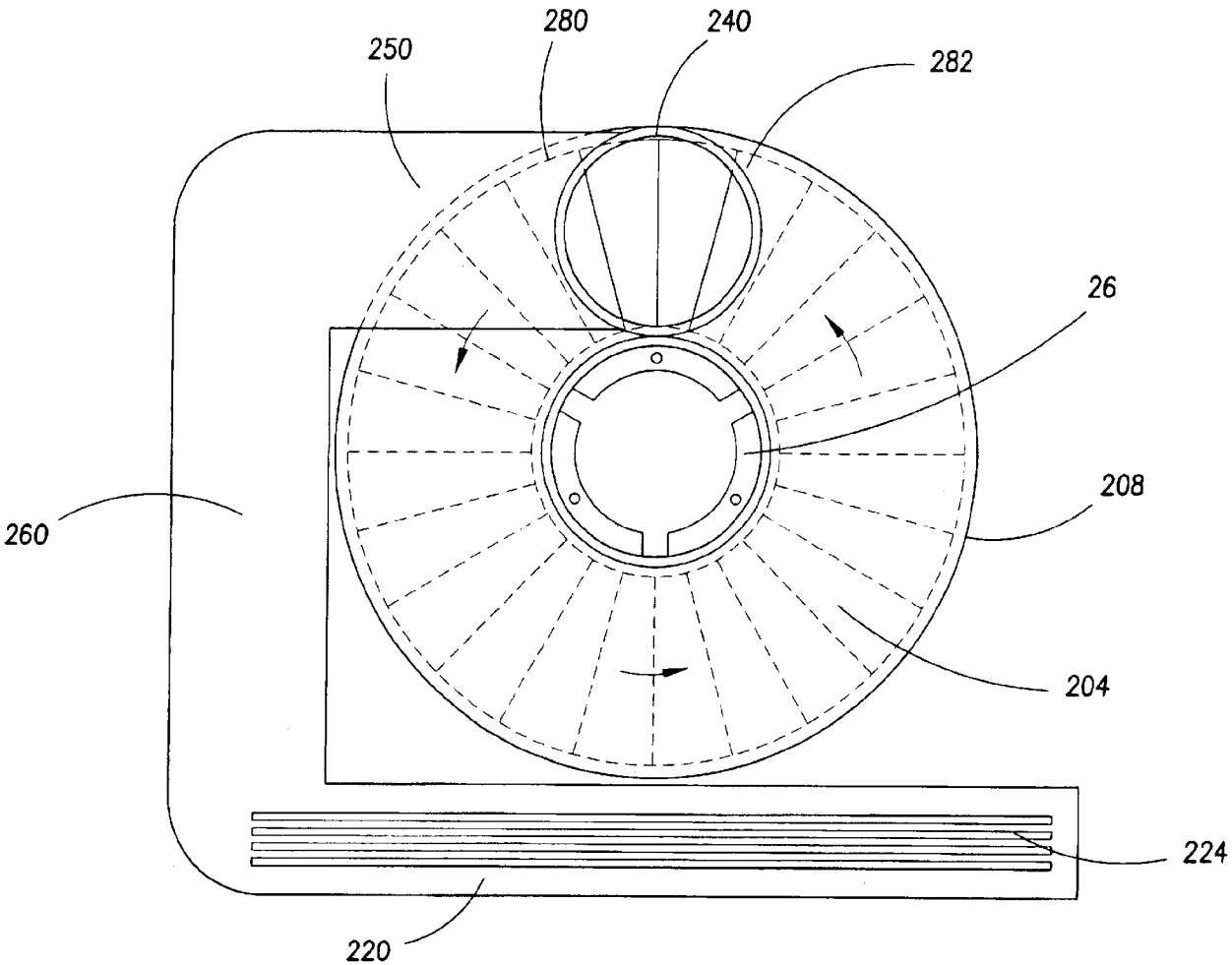
FIG. 14 is a top plan view of the motor housing and fan assembly shown in FIG. 13.
Figure 15:
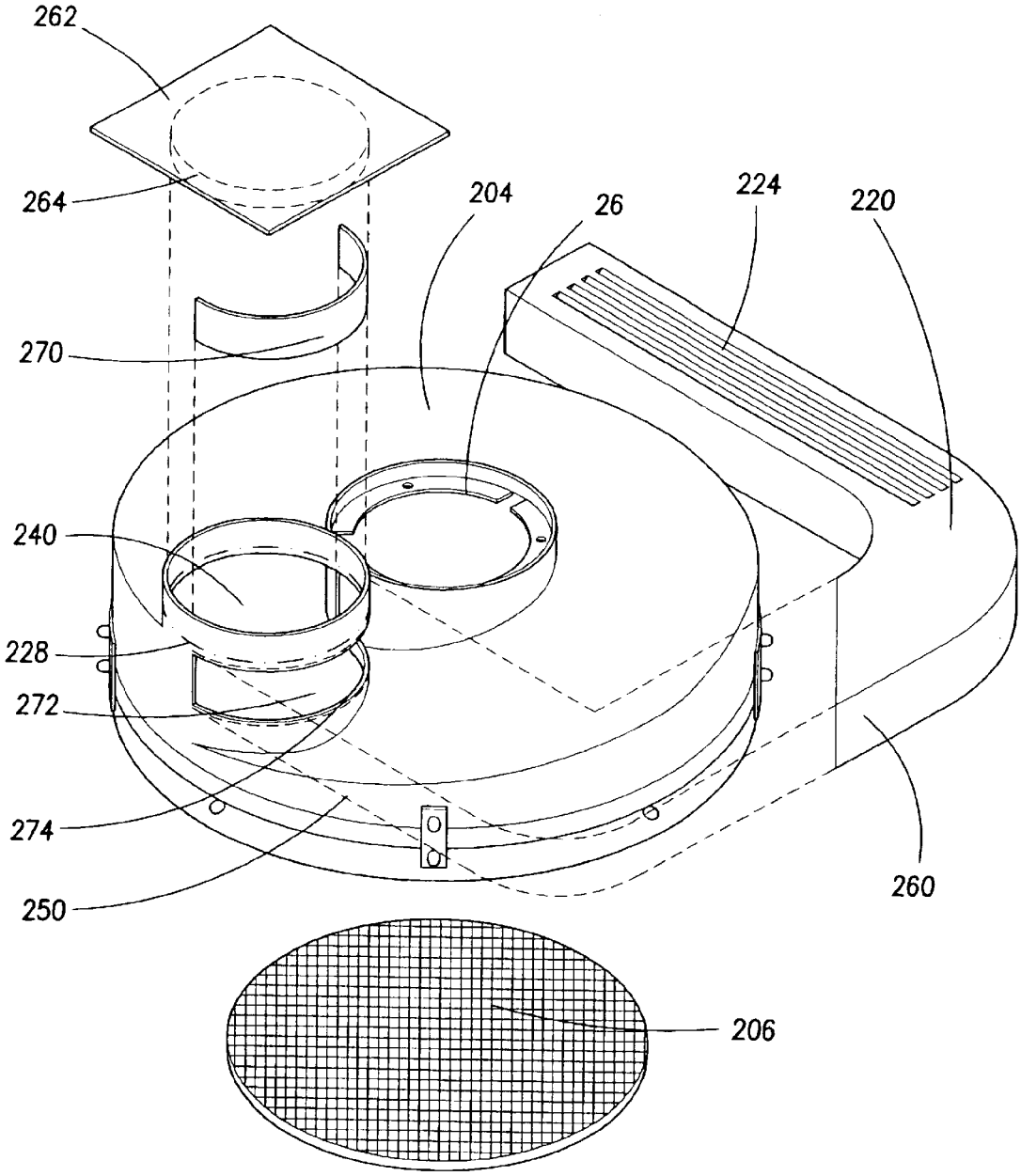
FIG. 15 is an exploded perspective view of the motor housing and fan assembly of FIG. 14 including a filter, cover and cap.
Figure 16:
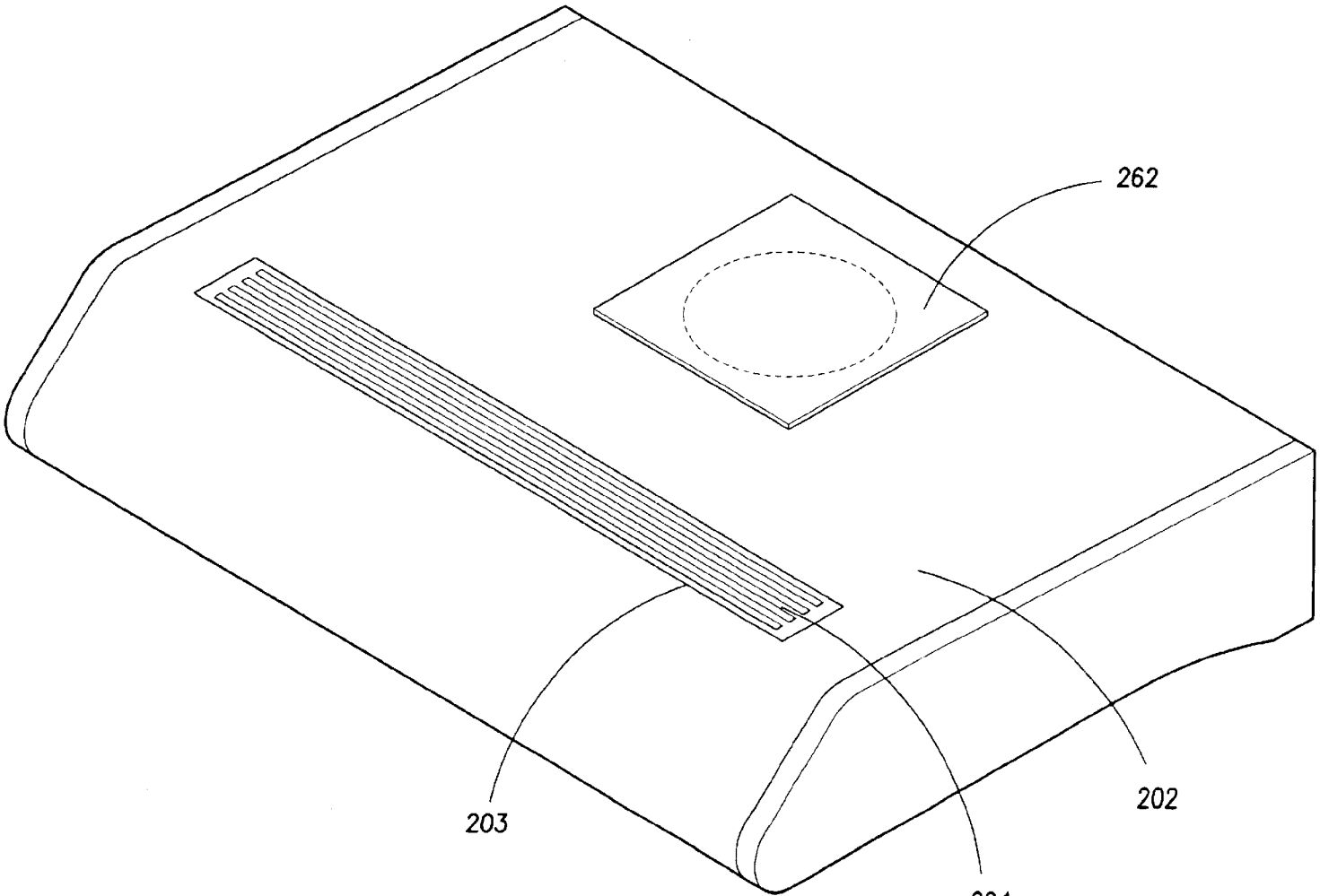
FIG. 16 is a top perspective view of a range hood equipped with the motor housing and fan assembly of FIG. 15.

A user may also adapt range hood 200 for use as an air recycler. Preferably the portion of the motor housing defining air outlet 240 has a weakened break-away seam 228 to provide for the easy separation of the protruding portion 254 from the top of the range hood body as shown in FIG. 13. Seam 228 is preferably at or below the level of the top surface of the hood body. Preferably seam 228 is punched into the material of the motor housing. The motor housing is painted after punching, preferably with a non-stick coating, which seals any gaps in the material along the seam. After knocking off protruding portion 254, plate 262 having a cylindrical cap 264 is used to block outlet 240. Cylindrical cap 264 is dimensioned to fit within outlet 240 and to prevent the escape of gases through outlet 240. Once the range hood is mounted in place below a cabinet, plate 262 is held firmly in place between the cabinet and the range hood. Gases passing through the motor housing enter air chamber 220 through opening 272, passing first through inlet portion 250 followed by intermediate portion 260 and finally exiting through the venting slits in outlet portion 224. Preferably, the bottom surface of is the air chamber is sloped from the outlet portion to the inlet portion so that any grease collecting within the interior will drain back to the motor housing and out to the grease cup.

Figure 17:
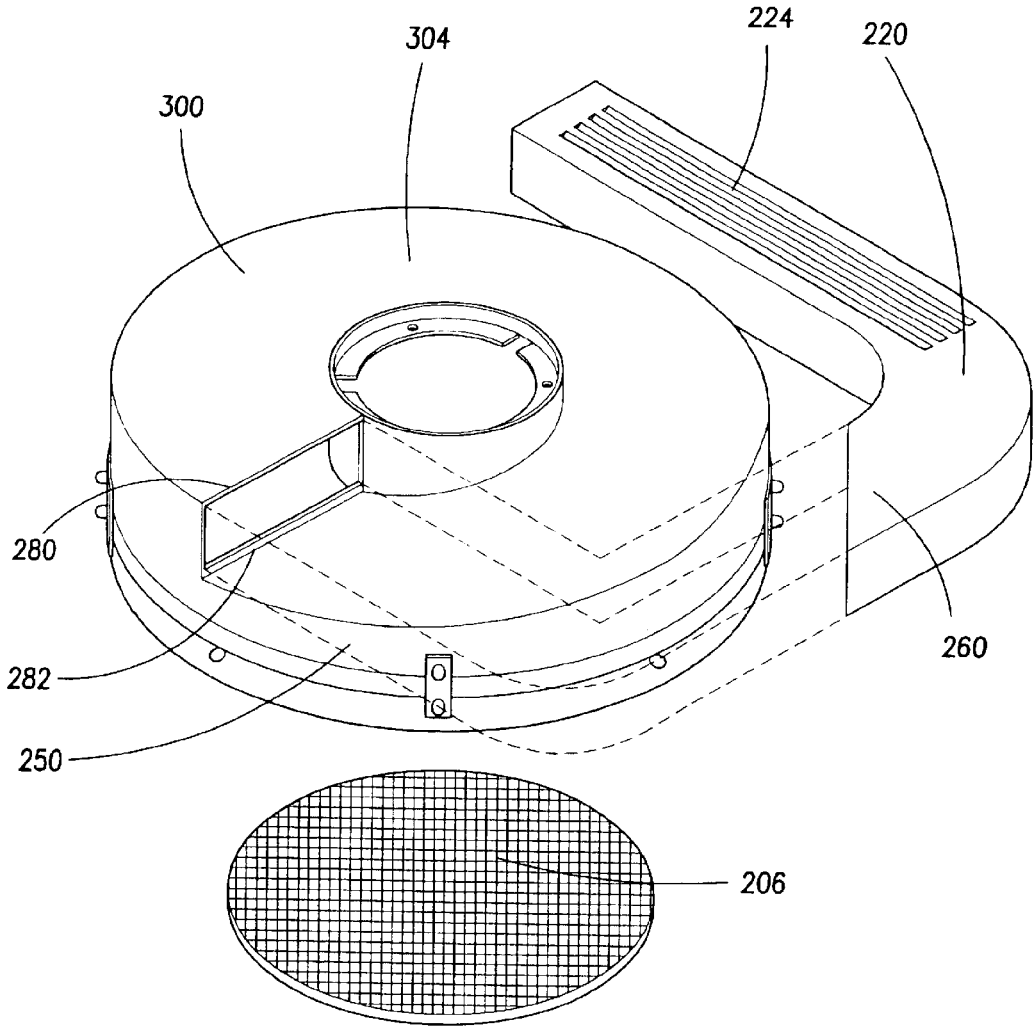
FIG. 17 is an exploded perspective view of a motor housing and fan assembly according to a further alternative embodiment of the invention.
Figure 18:
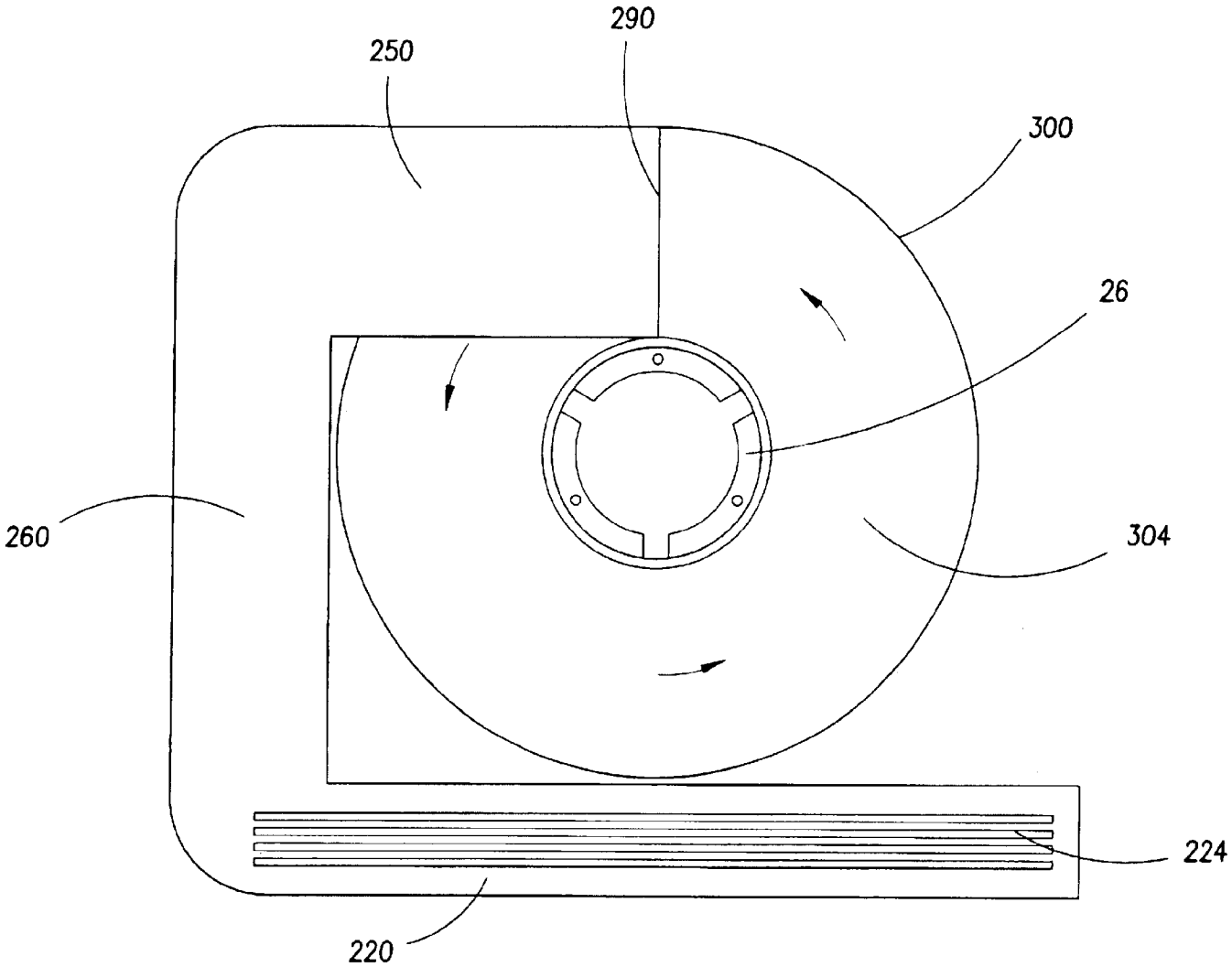
FIG. 18 is a top plan view of the motor housing and fan assembly of FIG. 17.

A further alternative embodiment is shown in FIGS. 17 and 18. In this embodiment, motor housing 300 is adapted solely for use in recycling air back into the room by way of air chamber 220. Motor housing 300 has a top surface 304 that spirals about housing mount 26 commencing at a first radial position 282 and terminating at a second radial position 280. The second radial position 280 is located above the first radial position 282 and an outlet opening is formed between the two. The inlet portion 250 of the air chamber 220 projects from the outlet opening. In order to reduce the amount of grease accumulating in the motor housing and air chamber, the motor housing 300 is equipped with a charcoal filter 206.

It will be appreciated by those skilled in the art that the preferred and alternative embodiments have been described in some detail but that certain modifications may be practiced without departing from the principles of the invention.

What is claimed is:

1. A range hood motor housing and fan assembly for exhausting gases generated above a cooking surface comprising:

an outer range hood body;

a motor housing having top, bottom and side surfaces defining a chamber, said motor housing being mounted within said hood body;

a motor housed within said motor housing chamber;

said motor including a fan having a plurality of fan blades, said fan adapted to rotate about said motor;

an air outlet located in said motor housing; and a space between said fan blades and said top surface of said motor housing, said space increasing in the direction of rotation of said fan from one side of said air outlet to the opposite side of said air outlet.

2. The assembly of claim 1 wherein said motor housing further comprises an upper section and a lower section, said sections being releasably connectable to one another.

3. The assembly of claim 1 wherein said bottom surface of said motor housing has a wall projecting into said chamber defining an air inlet.

4. The assembly of claim 1 wherein said air outlet is located in said top surface of said motor housing.

5. The assembly of claim 1 wherein said fan comprises:

a plurality of arcuate fan blades having front and rear faces;

a basket housing; and an outer cylindrical stabilizing element;

wherein said fan blades project radially from said basket housing to said outer cylindrical stabilizing element.

6. The assembly of claim 5 wherein said fan blades have at least one trough on said front face, said trough declining at an angle from said basket housing to said stabilizing element.

7. The assembly of claim 5 wherein said side surface is substantially cylindrical, said side surface and said stabilizing element being substantially concentric.

8. The assembly of claim 1 wherein a portion of said top surface and said air outlet overlaps said bottom surface.

9. The assembly of claim 1 further comprising an air exhaust chamber connected to said motor housing.

10. The assembly of claim 9 wherein said air exhaust chamber comprises an inlet portion, an intermediate portion and an outlet portion, said inlet portion being connected to said air outlet and said outlet portion being connected to an opening in said hood body.

11. The assembly of claim 10 wherein said outlet portion has venting slits disposed therein and aligned with said opening.

12. A fan for use within a range hood for exhausting gases generated above a cooking surface comprising:

a plurality of arcuate fan blades having front and rear faces;

a basket housing;

an outer cylindrical stabilizing element;

at least one trough on said front faces of said fan blades, said tough declining at an angle from said basket housing to said stabilizing element; and wherein said fan blades protect radially from said basket housing to said outer cylindrical stabilizing element.

13. The fan of claim 12 comprising two troughs, spaced one above the other on said front faces of said fan blades.

14. A motor housing and fan assembly for a range hood for exhausting gases generated above a cooking surface comprising:

a motor housing having top, bottom and side surfaces defining a chamber and having an air inlet and an air outlet;

a motor housed within said motor housing chamber;

said motor including a fan having a plurality of fan blades, said fan adapted to rotate about said motor; and a space between said fan blades and said top surface of said motor housing, said space increasing in the direction of rotation of said fan from a first position to a second position.

15. The assembly of claim 14 wherein said air outlet is defined in said motor housing between said first position and said second position.

16. The assembly of claim 15 further comprising an air exhaust chamber connected to said air outlet.

17. The assembly of claim 16 wherein said air exhaust chamber comprises an inlet portion, an intermediate portion and an outlet portion.

18. The assembly of claim 17 wherein said outlet portion has venting slits disposed therein and aligned with an opening in said hood body.

19. The assembly of claim 14 wherein said motor housing further comprises an upper section and a lower section, said sections being releasably connectable to one another.

20. The assembly of claim 14 wherein said fan comprises:

a plurality of arcuate fan blades having front and rear faces;

a basket housing; and an outer cylindrical stabilizing element;

wherein said fan blades project radially from said basket housing to said outer cylindrical stabilizing element.

21. The assembly of claim 20 wherein said fan blades have at least one trough on said front face, said trough declining from said basket housing to said stabilizing element.

22. The assembly of claim 14 further comprising an air exhaust chamber connected to said motor housing and wherein said air outlet is defined by a ventilation wall, said vent wall being connectable to external ducting.

* * * * *